US005257649A

United States Patent [19]

Froment

[11] Patent Number: 5,257,649

[45] Date of Patent: Nov. 2, 1993

[54] JACQUARD HOUSING SUPPORT SYSTEM

[75] Inventor: Jean-Paul Froment, Doussard, France

[73] Assignee: S.A. des Etablissements Staubli, Faverges, France

[21] Appl. No.: 984,545

[22] Filed: Dec. 2, 1992

[30] Foreign Application Priority Data

Dec. 11, 1991 [FR] France ..... 91 15615

[51] Int. Cl.[5] ..... D03C 3/18

[52] U.S. Cl. ..... 139/59

[58] Field of Search ..... 139/65, 59, 68, 430, 139/62-64, 55.1, 1 E

[56] References Cited

U.S. PATENT DOCUMENTS 4,172,475 10/1979 Schwarz et al. ..... 139/59

FOREIGN PATENT DOCUMENTS 0087519 9/1983 European Pat. Off. ..... 139/59

3249233 11/1991 Japan ..... 139/59

*Primary Examiner*—Andrew M. Falik

*Attorney, Agent, or Firm*—Dowell & Dowell

[57] ABSTRACT

A Jacquard system for making patterns on the selvedges of fabrics being woven in a loom which includes a hollow input shaft for controlling the vertical movement of heddle support cords. The input shaft extends through a housing and a principle drive shaft extends through and is drivingly connected to the input shaft. The housing includes clamping apparatus for its adjustment along a support beam extending parallel to the principal drive shaft.

3 Claims, 3 Drawing Sheets

JACQUARD HOUSING SUPPORT SYSTEM

BACKGROUND OF THE INVENTION 1. Field of the Invention

The present invention relates to small Jacquard systems especially provided to produce informative or decorative names, designs or other patterns on the selvedges of fabrics being woven. 2. History of the Related Art In conventional practice and as shown in FIG. 1 of the accompanying drawings, one system 1 has been used for simultaneously weaving of two selvedges (or even in certain cases of a third central selvedge). This single system 1 is supported by the end of a structure 2 which surmounts the weaving loom and is driven by a lateral transmission 3 which connects its input shaft to a shaft of the loom. As the selvedges comprise identical patterns, each of the actuation members or hooks 1*a* of the system 1 is, of course, associated with two (possibly three) harnesses 4 for controlling the heddles provided for weaving each selvedge.

It will be readily appreciated that these harnesses 4 are necessarily disposed in the vertical axis of the selvedges of the fabric 5 being made, with the result that their positioning must be capable of being modified as a function of the width of the fabric and the exact location thereof on the loom. Being given that, for such adjustment, it is not possible to shorten or lengthen the cords of the harnesses 4, it is necessary to provide complementary guide devices 6 whose displacement along the structure 2 makes it possible to adjust the vertical positioning of the harnesses without intervention on the length thereof.

Such guide devices 6 obviously complicate the construction and precise adjustment thereof is particularly delicate.

It is a principal object of the present invention to overcome these drawbacks by allocating to each selvedge to be woven an independent Jacquard system capable of being adjusted in horizontal position above the loom.

SUMMARY OF THE INVENTION

To that end, according to the invention, the system, directly equipped at its base with the harness board, is provided with a tubular input shaft which is traversed by a principal drive shaft connected to the shaft of the loom also, the system is provided with means for allowing it to be adjustably mounted on a support beam which extends horizontally, parallel to the principal shaft.

BRIEF DESCRIPTION OF THE DRAWINGS

The invention will be more readily understood on reading the following description with reference to the accompanying drawings, in which.

As indicated hereinabove.

DETAILED DESCRIPTION OF THE DRAWINGS

Figure 1:
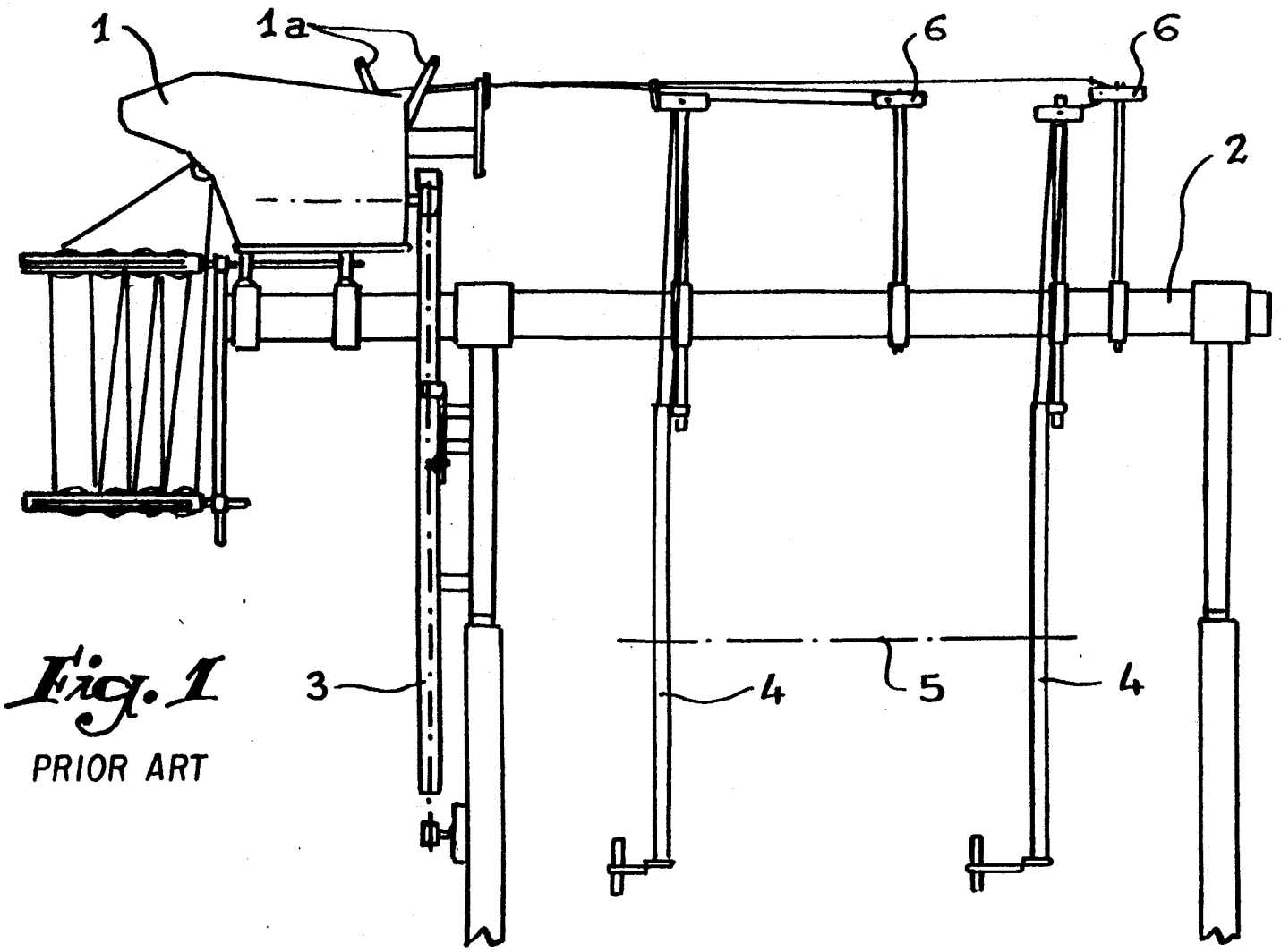
Fig. 1 PRIOR ART
FIG. 1 shows the general arrangement of a conventional Jacquard systems.
Figure 2:
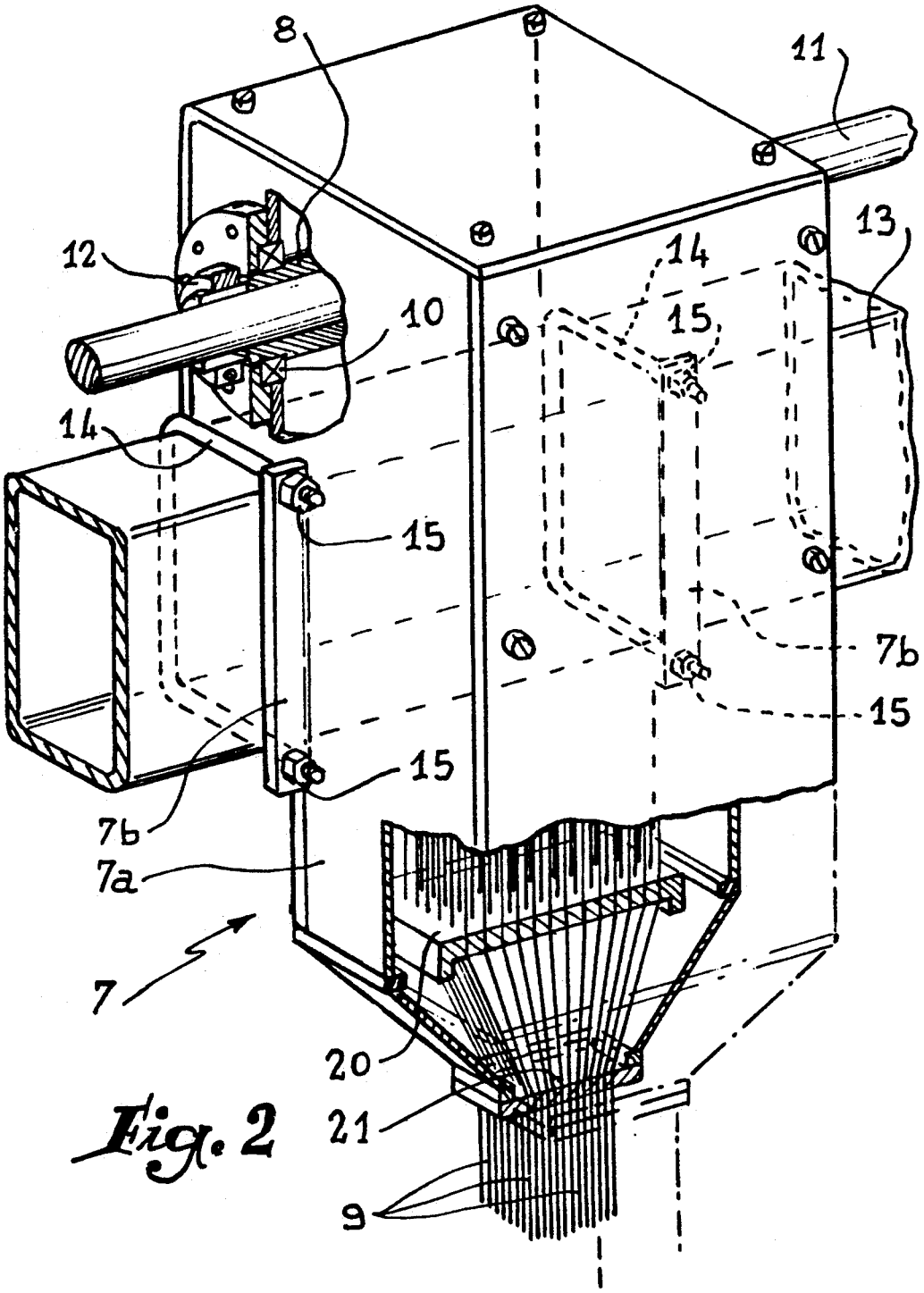
FIG. 2 is a view in perspective of a system according to the invention.

Referring again to the drawings, the system 7 illustrated in FIG. 2 comprises, in manner known per se, an input shaft 8 which receives its movement (reciprocating or continuous depending on the case) of the weaving loom with which it is associated and which transforms it for the vertical control of the cords 9 of a corresponding harness.

According to the present invention, shaft 8, supported by bearings 10 in the lateral walls of the housing 7*a* of the system 7, is tubular and it is axially traversed by a principal drive shaft 11, oriented horizontally. Shafts 8 and 11 are rendered rotatably and axially secured to one another with the aid of a clamp 12 which acts on one end, which is split.

Furthermore, the lateral walls of the housing 7*a* of system 7 are channelled so as to define two opposite horizontal faces adapted to abut on a beam or support 13, oriented horizontally below the shaft 11. Housing 7*a* is secured on beam 13 by two lateral stirrups 14 associated with folded-back lugs 7*b* of housing 7*a* and tightening nuts 15.

Figure 3:
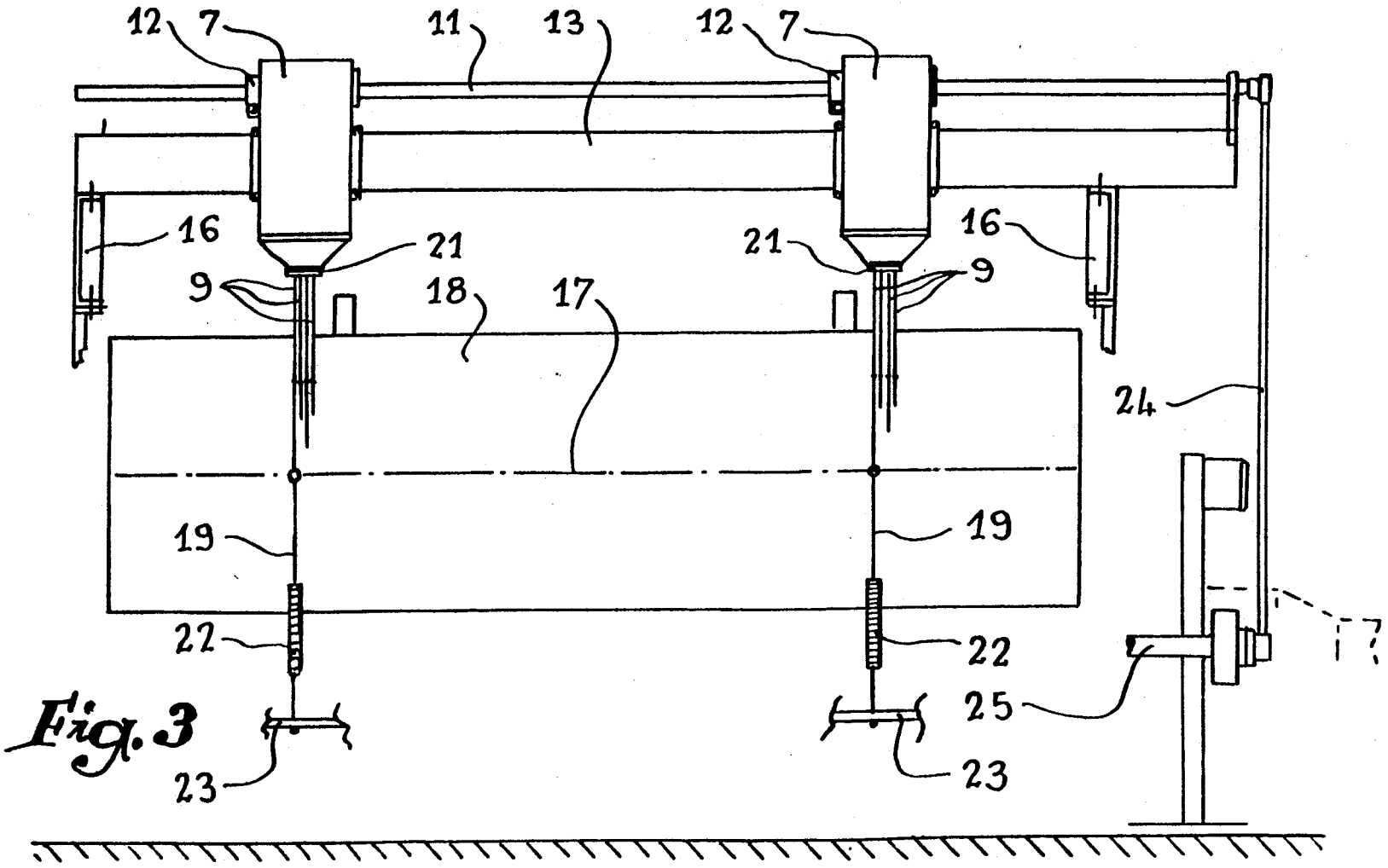
FIG. 3 schematically illustrates the assembly of two systems according to FIG. 2 on a weaving loom.

As illustrated in FIG. 3, beam 13 surmounted by the principal actuation shaft 11 is supported by lateral columns 16 so as to be disposed above the fabric 17 formed with the aid of conventional heddle frames 18 controlled by a conventional dobby. To make the desired patterns for the selvedges of this fabric 17, two systems 7 according to the invention have been engaged on shaft 11 and on beam 13, and it will be understood that, by adjusting clamps 12 and nuts 15, these two systems 7 are capable of being very easily brought to a position such that the heddles 19 of their harness are disposed level with the selvedges to be made.

It should be observed in this respect that each system 7 is arranged as described in Applicants' French Pat. application Ser. No. 91 07275 filed on Jun. 10, 1990. The cords 19 extend through openings made in two harness boards 20 and 21 rigidly mounted in superposition to the base of the housing 7*a*, so that they are guided vertically to support the heddles 19 and the horizontal displacement of this housing ensures corresponding displacement of the heddles, without need for adjustment other than the slide of the return springs 22 along the conventional bar 23.

As in the prior art, one of the ends of the shaft 11 is associated with a transmission 24 connected to a shaft 25 of the loom. The two systems 7 are thus driven in synchronism in order to effect the same weaving.

It goes without saying that beam 13 is capable of supporting any number of systems 7.

It must, moreover, be understood that the foregoing description has been given only by way of example and that it in no way limits the domain of the invention which would not be exceeded by replacing the details described by any other equivalents. In particular, shafts 8 and 11 are capable of being provided to be splined, the first internally, the second externally, in which case clamps 12 may obviously be dispensed with.

What is claimed is:

1. In a Jacquard system for making patterns on selvedges of fabrics being woven in a loom, wherein the system includes a housing having a base and at least one harness board for guiding heddle support cords at it's base, the improvement comprising, a tubular input shaft for controlling vertical movement of the heddle support cords, said tubular input shaft extending through the housing, a principal drive shaft extending through said input shaft, first means for drivingly connecting said principal drive shaft to said input shaft, second means for connecting said principal drive shaft to a control drive shaft of the loom, and means for adjustably connecting the housing to a loom support beam whereby the alignment of the heddle support cords may be selectively adjusted by shifting the housing along said support beams.

2. The Jacquard system of claim 1, in which said first means for connecting said principal drive shaft to said input shaft includes at least one clamp, said input shaft having an end, and said at least one clamp being engagable about said end.

3. The Jacquard system of claim 1, wherein the housing includes an outwardly extending lug, and said means for adjustably connecting the housing to said support beam includes a clamp means extendable about said support beam and through said lug, and means for selectively tightening said clamp relative to said support beam.

* * * * *